US005321899A

United States Patent [19]

Kade et al.

[11] Patent Number: 5,321,899

[45] Date of Patent: Jun. 21, 1994

[54] DRY END

[75] Inventors: Werner Kade, Neenah, Wis.; Wilfried Kraft; Wolfgang Mayer, both of Heidenheim, Fed. Rep. of Germany

[73] Assignee: J. M. Voith GmbH, Fed. Rep. of Germany

[21] Appl. No.: 867,411

[22] Filed: Apr. 13, 1992

[51] Int. Cl.[5] ..... F26B 11/02

[52] U.S. Cl. ..... 34/114; 34/117; 34/120

[58] Field of Search ..... 34/114, 115, 116, 117, 34/120, 122, 123

[56] References Cited

U.S. PATENT DOCUMENTS

| | | | |
|---|---|---|---|
| 4,172,007 | 10/1979 | Kankaanpää34 | 117/ |
| 4,934,067 | 6/1990 | Wedel | 34/116 |
| 5,022,163 | 6/1991 | Iivespaa et al. | 34/115 |
| 5,063,689 | 11/1991 | Sollinger | 34/117 |
| 5,065,529 | 11/1991 | Skaugen et al. | 34/117 |
| 5,101,577 | 4/1992 | Wedel | 34/117 |
| 5,105,561 | 4/1992 | Wulz | 34/117 |
| 5,144,758 | 9/1992 | Skaugen et al. | 34/117 |
| 5,146,696 | 9/1992 | Mayer et al. | 34/116 |

FOREIGN PATENT DOCUMENTS

| | | |
|---|---|---|
| 426607 | 5/1991 | European Pat. Off. . |
| 9001209 | 5/1990 | Fed. Rep. of Germany . |

*Primary Examiner*—Denise Gromada

*Attorney, Agent, or Firm*—Ostrolenk, Faber, Gerb & Soffen

[57] ABSTRACT

The dry end of a paper machine comprises a first dryer group with top drying cylinders (11 to 14), with a first drying wire (10) and with bottom deflection suction rolls (21 to 23). Adjacent this, there is a second dryer group with bottom drying cylinders (15 to 18), with a second drying screen (20) and with top deflection suction rolls (25 to 27). In this way, both sides of the web (9) to be dried come, in succession, into direct contact with the drying cylinders. At the place where the web (9) changes from the first drying wire to the second drying wire, there is a transfer suction roll (24) which lies within the loop (20) of the second support belt. The web (9) travels there from the last cylinder (14) of the first dryer group over an at least approximately straight travel path to the transfer suction roll (24) and thus onto the second support belt (20).

31 Claims, 2 Drawing Sheets

DRY END

BACKGROUND OF THE INVENTION

The present invention relates to a dry end or a machine for the manufacture of a fiber web, and particularly to means which improve the web transfer from one dryer group to the next one, particularly a paper web. The invention proceeds from a dry end having two successive single tier dryer groups, with one group drying one side of the web and the other group drying the other side of the web. Each group of dryers has a respective web support belt passing around it. The web is transferred from the support belt of the preceding dryer group to the support belt of the succeeding group.

With respect to the state of the art, reference is had to the following publications:

Federal Republic of Germany Utility Model corresponding to U.S. Ser. No. 07/825,395 and European Patent publication 0426607, corresponding to U.S. Pat. No. 5,101,577.

The invention relates to a dry end which has at least two single-tier dryer groups and in which the one side of the web comes into contact with the cylinders of the one dryer group and the other side of the web with the cylinders of the other dryer group. In other words, the so-called separation place where the web transfers from one dryer group to the other is developed as a place of reversal. Two dryer groups of this type can be arranged in the initial upstream region of a dry end, where, therefore, the web to be dried is still relatively wet. It is entirely possible for a large number of dryer groups to be arranged one behind the other, each with a respective place of reversal between two adjacent dryer groups. If necessary, the entire dry end of a paper manufacturing machine can be divided into dryer groups in the manner that all places of separation are developed as reversal places. However, it is also possible to provide, for instance, two or three dryer groups with places of reversal only in the end region of the dry end. In such case, several dryer groups are connected one behind the other in the initial region of the dry end, and all of the cylinders of these initial groups come into contact only with the bottom side of the web.

In the first mentioned reference above, the web travels on a meander-like path from the last cylinder of the first, dryer group the first cylinder of the second dryer group. Within that meander-like path, the web initially travels together with the, first support belt of the first group and then with the second support belt of the first group. For this, two deflection suction rolls are required, each of which must have a very large suction zone (the suction zone must extend over more than half of the circumference of the roll). The amount of air to be drawn off is therefore relatively high. Furthermore, the arrangement requires a relatively large amount of space and therefore a relatively large horizontal distance between the said two drying cylinders.

According to the second reference an at least approximately linear path of travel from the last cylinder of the first dryer group to the first cylinder of the second dryer group is provided for the web which is to be dried. Since, however, the two support belts cover one another at the place where the web shifts from one support belt to the other, a relatively large distance is again required between the two dryer cylinders.

In accordance with FIG. 6 of the second reference, a space is provided between the two support belts which cover one another so that the web is transferred over a free travel path, i.e. without support, from one wire belt to the other. With regard to this, it is stated in that reference that said space makes it possible for the second support belt to travel at a higher speed than the first support belt so that the web is maintained under tension.

SUMMARY OF THE INVENTION

The object of the present invention is to develop the above-mentioned dry end in such a manner that the path of travel of the web is as simple as possible in the region of the place of separation which is developed as a reversal place, i.e. that said path has as few deflections as possible, and that, nevertheless, the distance between the drying cylinders at the place of separation can be as small as possible so that a total length of the dry end which is smaller than what was previously known is obtained.

This object is achieved by the invention. In accordance therewith, a so-called transfer roll is provided at the place of separation and in the loop of the second support belt, the web forming with the transfer roll only a small angle of wrap of preferably 30° to 50° (in rare exceptional cases up to a maximum of 90°). One essential feature of the transfer roll is that its cylindrical surface has recesses, for instance holes, preferably continuous holes or circumferential grooves. In this way, it is able to absorb a stream of air which arrives with the web, so that the web together with the second support belt travels without problems (and, in particular, without the formation of a bubble) to the first drying cylinder of the following dryer group.

The transfer roll is preferably developed as a suction roll. Due to the above-mentioned small angle of wrap, the transfer suction roll requires only a relatively small suction zone. It will therefore, as a rule, be provided with an internal stationary suction box having longitudinal sealing strips which are arranged in accordance with the relatively small suction zone desired. Thus, relatively little air need be drawn off in order to produce the vacuum in the suction zone.

In accordance with the invention, the transfer roll is the only roll which need be arranged at the place of separation directly between the two adjacent drying cylinders. Therefore, these two drying cylinders can be arranged at a relatively small distance from each other. If, at the same time, a certain difference in height is provided, as is known, between the adjacent drying cylinders, a considerable reduction in the horizontal distance can be obtained. Accordingly, the overall structural length of the dry end is reduced, particularly if several places of separations of the type described are present.

Another advantage of the arrangement in accordance with the invention is that—as is frequently necessary—a free, i.e. unsupported, travel path can be provided at the place of separation for the web which is to be dried. In this case, one speaks of an "open place of separation". In accordance with the invention, the path of free travel always terminates at the circumference of the transfer roll, preferably in the region of the suction zone, if a transfer suction roll is provided. If, at the same time, the first support belt, by means of a guide roll (lying within the loop of the first support belt), supports the web up to the start of the free travel path, then the beginning and end of the free travel path are unambiguously defined. As a result, the web passes quietly and dependably over the free travel path (this in contradistinction to the arrangement in accordance with the second reference FIG. 6).

The above-described free travel path of the web can be used as follows: If the open place of separation is located in the initial region of the dry end, the second dryer group can—as known per se—be driven with a slightly higher speed than the first dryer group. In this way, the still relatively wet web which is increasing in length (as a result of increase in temperature) can be held cautiously under a certain tensile stress. If, on the other hand, the open place of separation is located in the end region of the dry end, then the second dryer group can be driven with a slightly *smaller* speed than the first dryer group. In this way, the fact can be taken into account that the web shrinks its moisture content becomes less. In this way, longitudinal stresses resulting therefrom can be reduced. Thus, the danger of the web tearing in the end region of the dry end as a result of possible longitudinal stresses is counter-acted. This danger will be greater the more one wishes to dry the web and therefore the smaller the remaining residual moisture content is to be. Due to the negative difference in speed described, it will therefore be possible to dry the web more strongly than heretofore. With some types of paper, this facilitates further processing, for instance in a coater or in a glazing calender.

BRIEF DESCRIPTION OF THE DRAWINGS

Further explanations of the invention and of the developments indicated in the subordinate claims are given in the following description of the embodiments shown in the drawing. Each of FIGS. 1 and 2 diagrammatically represents a side view of a dry end which is part of a paper manufacturing machine.

DESCRIPTION OF THE PREFERRED EMBODIMENTS

Figure 1:
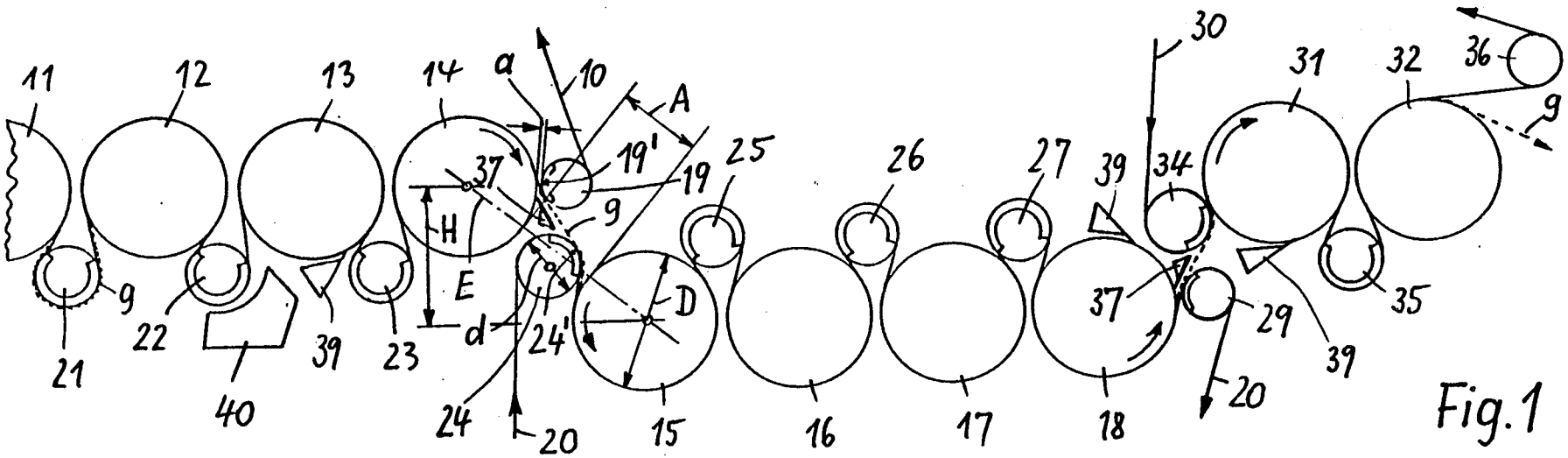
Figure 2:
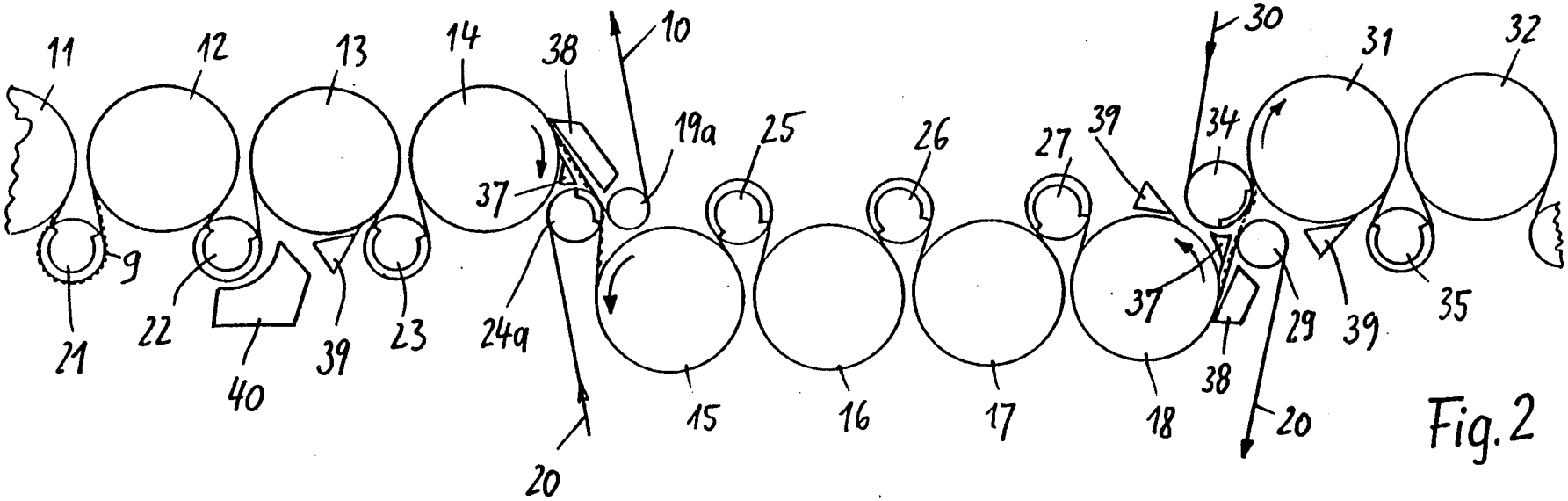

In both FIGS. 1 and 2, the paper web 9 to be dried (shown in part as a dotted line) travels from left to right through the dry end. A first dryer group comprises, for instance, four top heatable drying cylinders 11 to 14 and three bottom deflection suction rolls 21 to 23. A first endless porous support belt 10, which is preferably developed as a drying wire, travels in meander form alternately over the drying cylinders and the deflection suction rolls and, behind or following the last drying cylinder 14, over a guide roll 19 back to the beginning of the first dryer group. The paper web 9 is continuously conducted by the support belt 10 from the first drying cylinder 11 to the guide roll 19, the lower side of the paper being in direct contact with the drying cylinders. The deflection suction rolls 21 to 23 are provided in known manner with perforated walls so that the paper web 9 is held fast by vacuum against the support belt in the region of these deflection suction rolls. Deflection suction rolls are shown symbolically with inner stationary suction boxes. Instead of this, known box-less suction rolls can also be used. An asymmetric arrangement of the deflection suction rolls between the adjacent cylinders is shown. There is namely a very small distance between the deflection suction roll and the preceding cylinder and a larger distance between the deflection suction roll and the following cylinder. However, a symmetrical arrangement is also possible.

The second dryer group comprises, for instance, four bottom drying cylinders 15 to 18 and three top deflection suction rolls 25 to 27. A second support belt 20 travels through this dryer group, namely first of all over a so-called transfer suction roll 24 which is arranged directly in front of the first drying cylinder 15. More precisely, the transfer suction roll 24 lies between the last drying cylinder 14 of the first dryer group and the first drying cylinder 15 of the second dryer group. As shown in FIG. 1, a paper web 9 moves over the free travel path from the first support belt 10 to the second support belt 20. The free travel path commences at the circumference of the guide roll 19 and ends in the region of the suction zone 24' on the circumference of the transfer suction roll 24. In the second dryer group, the upper side of the paper comes into contact with the drying cylinders 15 to 18.

From FIG. 1 it can be noted that the paper web 9 wraps around the transfer suction roll 24 only over a small part of its circumference. An angle of wrap of, for instance, 30° to 50° is preferred. It is namely desired to obtain the result that the paper web 9 is deflected as little as possible on its path between the cylinders 14 and 15. This facilitates the threading of the paper web into the dry end (upon the starting of the paper machine or after a tear in the paper web), and in particular the transfer of the tip of the edge strip of the paper web which, in known manner, first passes through the dry end. In this connection, a band carrier is not necessary, in contradistinction to older arrangements.

The place of separation between the two dryer groups 11 to 14 and 15 to 18, which place is open as described above (and developed as reversal place), is furthermore characterized by the fact that—in particular between the last cylinder 14 of the first dryer group and the transfer suction roll 24—an at least approximately straight path of travel is provided for the paper web 9. In other words, the guide roll 19 which lies behind the cylinder 14 is wrapped only over a very small angle by the paper web 9, which angle may be between 0° and 30°. The axis of the transfer suction roll 24 is located, as shown in FIG. 1, close to a plane E which is determined by the axes of the two adjacent drying cylinders 14 and 15. In FIG. 1, the axis of the transfer suction roll 24 lies somewhat below said plane E. The axis can, however, also lie precisely within this plane E or, by way of exception, somewhat above it. In such exceptional case, the paper web 9 would wrap the transfer suction roll over a somewhat larger angle. However, this angle should not exceed 90°.

Figure 3:
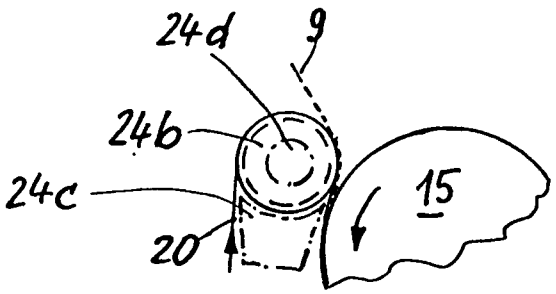
FIG. 3 shows a transfer roll which differs from FIG. 1.

In accordance with the diagrammatic showing in FIG. 1, the transfer suction roll has a perforated roll shell and an internal suction box which defines the suction zone 24'. Differing from this, in accordance with FIG. 3 other known constructions for the transfer roll 24*b* can also be provided. For instance, the shell of the roll, which is symbolically represented by a dash-line circle, may have circumferential grooves and/or holes. In the latter case, continuous holes are preferred since an oncoming stream of air can escape inwards. A roll shell provided with circumferential grooves can, if necessary, be combined with a known external suction box 24*c*. If the roll shell is perforated air can, if necessary, be drawn off through a hollow journal 24*d*.

In accordance with FIG. 1, the drying cylinders 11 to 14 and 15 to 18 are arranged in horizontal rows. The cylinders 11 to 14 of the first dryer group lie a difference in height H above the cylinders 15 to 18 of the second dryer group. The difference in height H is approximately equal to the cylinder diameter D. The clear distance A, measured in the plane E, between the two adjacent drying cylinders 14 and 15, is approximately equal to one-half of a cylinder diameter D or even less. By the largest possible difference in height H and the smallest possible spacing A, the greatest possible reduction in the total structural length of the dry end is obtained. Preferably, therefore, the diameter d of the transfer suction roll 24 is selected as small as possible; furthermore, the said clear distance A between the two drying cylinders 14 and 15 is only slightly greater than the roll diameter d. In this connection, it is advantageous, in particular, to keep the distance between the transfer suction roll 24 and the following drying cylinder 15 as small as possible. This also contributes to dependable guidance of the paper web 9.

Differing from FIG. 1, it is also possible to arrange all rows of cylinders at the same height (in accordance with Federal Republic of Germany P 40 37 423.8. which is equivalent to U.S. Ser. No. 07/664,545 now U.S. Pat. No. 5,146,696), namely when a somewhat larger overall structural length of the dry end can be tolerated.

The guide roll 19 can be developed as a simple, smooth roll. Differing from this, it can however also be developed as a suction roll with a small suction zone 19 (represented diagrammatically by dash lines). This suction zone is arranged at the place where the paper web 9 and the support belt 10 move off from the drying cylinder 14. In order to provide assurance that the paper web, as far as possible, travels together with the support belt at this run-off point, the guide roll 19 is arranged at a very small distance a from the circumference of the cylinder 14. For this same purpose, a stationary suction device 38 can be provided at the said run-off point, as shown in FIG. 2, for instance in the form of a known web stabilizer. In both variants, it is favorable to provide a narrow scraper 37 in the region of the operator-side edge of the paper web directly behind the point where the web runs off from the last cylinder 14 of the first dryer group. This scraper serves (upon the threading of the paper web into the dry end) for detaching the oncoming tip of the edge strip of the paper web from the cylinder 14. This scraper 37 can be provided in known manner with a blast device which conducts the edge strip to the transfer suction roll 24.

In FIG. 1 there is also shown a third dryer group comprising two top drying cylinders 31 and 32, a transfer suction roll 34, a deflection suction roll 35, and a normal guide roll 36 arranged behind the last cylinder 32. It is assumed that this dryer group 31, 32 is the last dryer group of a dry end from which the completely dried paper web 9 travels to a subsequent station, which is not shown in the drawing (for instance, a calendar, reel, size press, coater or the like). The place of separation between the cylinders 18 and 31 is in its turn developed as an open place of separation, corresponding to the place of separation described above between the cylinders 14 and 15.

In accordance with FIG. 2, the place of separation between the cylinders 14 and 15 is developed (differing from FIG. 1) as a closed place of separation. Here, namely, the first support belt 10 travels together with the web 9 over a linear travel path up to the transfer suction roll 24*a*. There the web detaches from the first support belt and travels further together with the second support belt 20 to the first drying cylinder 15 of the second dryer group. The first support belt 10 travels from the transfer suction roll 24*a* to a normal guide roll 19*a* and from there back to the start of the first dryer group. The second dryer group of FIG. 2 is followed by a third dryer group 30 to 35, shown only in part, the place of separation being developed as open place of separation in the same way as in FIG. 1.

The following applies to both FIGS. 1 and 2: In addition to the aforementioned narrow edge-strip scrapers 37, there is provided, at least on a part of the drying cylinders, a scraper 39 which extends over the entire width of the web. A known hot air blast box 40 can be provided on each deflection suction roll, as shown by way of example on the deflection suction roll 22.

We claim:

1. A dry end of a paper manufacturing machine, comprising:

a first dryer group comprising a first plurality of rotatable, heatable first drying cylinders which are rotatable in a first direction; a respective first deflection suction roll between each two of the first drying cylinders; a first endless loop support belt having one side for supporting the web to be dried, and the first support belt being passed through the first dryer group along a meander path so that a first side of the supported paper web comes into direct contact with the first drying cylinders and the first support belt comes into direct contact with the first deflection suction rolls;

a second dryer group immediately following the first dryer group, the second dryer group comprising a second plurality of rotatable, heatable second drying cylinders, which are rotatable in a second direction opposite the first direction; a respective second deflection suction roll between each two of the second drying cylinders; a second endless loop support belt having a respective one side for supporting the web to be dried, and the second support belt being passed through the second dryer group along a second meander path so that the second side of the paper web opposite the first side thereof comes into direct contact with the second drying cylinders and the second support belt comes into direct contact with the second deflection suction rolls;

the first dryer group having a last one of the first drying cylinders in the web path toward the second dryer group, the second dryer group having an initial drying cylinder in the path of the web after the first dryer group;

a transfer roll within the loop of the second endless loop belt, the transfer roll being located between the first and the second dryer groups; the transfer roll being placed with respect to the last of the first drying cylinders and with respect to the initial second drying cylinder that the web passing between those two drying cylinders wraps around a circumference of the transfer roll over a wrap angle of at most 90°, and wherein the web travels along a free, unsupported travel path as the web is transferred from the first belt to the second belt, the free travel path of the web terminating at the circumference of the transfer roll.

2. The dry end of claim 1, wherein the transfer roll is a suction roll which applies suction to the web moving past the transfer roll for removing the web from the first belt and transferring the web to the second belt.

3. The dry end of claim 2, further comprising a guide roll within the loop of the first endless loop support belt and following after the last of the first drying cylinders in the path of the first belt through the first dryer group, the guide roll being positioned to cause the first belt passing around the guide roll to contact the web in the path of travel of the web from the last of the first drying cylinders to the transfer roll.

4. The dry end of claim 3, wherein the first support belt travels together with the web over a straight path of travel to the transfer suction roll, and the transfer suction roll includes suction means for separating the web from the first support belt;

the guide roll being so placed with respect to the transfer roll and also in the loop of the first support belt that the first support belt passes by the transfer roll and then passes around the guide roll in the path of the support belt after the transfer roll has removed the web from the first support belt.

5. The dry end of claim 2, wherein the transfer suction roll has a suction zone defined at the surface thereof, the suction zone extending over a larger circumferential region of the transfer roll than the part of the circumference thereof wrapped by the web.

6. The dry end of claim 2, wherein the suction zone of the transfer suction roll is extended in the direction opposite and upstream of the direction of web travel over the part of the circumference thereof wrapped by the web.

7. The dry end of claim 1, wherein the transfer roll has a roll shell and the roll shell is shaped to provide air receiving and passing means therein for providing suction to the web moving past the transfer roll.

8. The dry end of claim 7, where the air receiving and passing means comprises circumferential grooves around the roll shell.

9. The dry end of claim 7, wherein the air receiving and passing means comprises holes through the roll shell.

10. The dry end of claim 1, wherein the last of the first drying cylinders and the transfer roll are respectively so placed, without interfering elements therebetween, that the web follows an at least approximately straight path of travel from the last of the first drying cylinders to the transfer roll.

11. The dry end of claim 10, further comprising a guide roll within the loop of the first endless loop support belt and following after the last of the first drying cylinders in the path of the first belt through the first dryer group, the guide roll being positioned to cause the first belt passing around the guide roll to contact the web in the path of travel of the web from the last of the first drying cylinders to the transfer roll.

12. The dry end of claim 11, wherein the guide roll is so shaped and so placed with respect to both the last of the first drying cylinders and the transfer roll that the web passing between the last of the first drying cylinders and the transfer roll wraps around the guide roll over an angle of between 0° and 30°.

13. The dry end of claim 12, wherein there is a plane defined between the axis of the last of the first drying cylinders and the axis of the initial second drying cylinder, the transfer roll having an axis which lies generally close to the plane of the axis of the last of the first drying cylinders and the initial second drying cylinders.

14. The dry end of claim 11, wherein the guide roll is so shaped and so placed with respect to both the last of the first drying cylinders and the transfer roll that the web passing between the last of the first drying cylinders and the transfer roll wraps around the guide roll over an angle of at most 15°.

15. The dry end of claim 11, further comprising a stationary suction device arranged within the loop of the first endless loop belt and in the region of the run off point of the web from the last one of the first dryer cylinders.

16. The dry end of claim 15, further comprising a narrow scraper for detaching a tip of a transfer edge strip of the web, the scraper being positioned at the last of the first drying cylinders just beyond the point where the web runs off the last of the first dryer cylinders.

17. The dry end of claim 10, wherein there is a plane defined between the axis of the last of the first drying cylinders and the axis of the initial second drying cylinder, the transfer roll having an axis which lies generally close to the plane of the axis of the last of the first drying cylinders and the initial second drying cylinder.

18. The dry end of claim 17, wherein the last of the first drying cylinders land the initial second drying cylinder have the same respective cylinder diameter and are so placed as to be spaced a clear distance apart approximately half of the cylinder in diameter.

19. The dry end of claim 18, wherein the transfer roll has a respective diameter and the last of the first drying cylinders and the initial second drying cylinder are spaced apart by a distance slightly greater than the diameter of the transfer suction roll.

20. The dry end of claim 10, wherein the transfer roll has a respective diameter and the last of the first drying cylinders and the initial second drying cylinder are spaced apart by a distance slightly greater than the diameter of the transfer roll.

21. The dry end of claim 12, wherein the guide roll is spaced a small distance from the last of the first drying cylinders.

22. The dry end of claim 21, wherein the guide roll has a suction zone defined thereon in the region of the web run off point of the last of the first drying cylinders.

23. The dry end of claim 12, wherein the guide roll has a suction zone defined thereon in the region of the web run off point of the last of the first drying cylinders.

24. The dry end of claim 1, further comprising a narrow scraper for detaching a tip of a transfer edge strip of the web, the scraper being positioned at the last of the first drying cylinders just beyond the point where the web runs off the last of the first dryer cylinder.

25. The dry end of claim 1, wherein the first drying cylinders are arranged in a first horizontal row and the second drying cylinders are arranged in a second, different horizontal row, and the group of drying cylinders which contact the bottom side of the web are arranged at a height above the group of drying cylinders which contact the top side of the web.

26. The dry end of claim 25, wherein the height difference of the groups of drying cylinders is approximately equal to the diameter of one of the drying cylinders.

27. The dry end of claim 1, wherein the first and the second dryer groups are drivable at different respective speeds.

28. The dry end of claim 27, wherein the first and the second dryer groups are arranged in the end region of the dry end, and the second dryer group is drivable at a lower speed than the first dryer group.

29. The dry end of claim 1, wherein the transfer roll is so placed with respect to the last of the first drying cylinders and the initial second drying cylinder that the web passing between the two drying cylinders wraps around the transfer roll over a wrap angle between 30° and 50°.

30. A dry end of a paper manufacturing machine, comprising:

a first dryer group comprising a first plurality of rotatable, heatable first drying cylinders which are rotatable in a first direction; a respective first deflection suction roll between each two of the first drying cylinders; a first endless loop support belt having one side for supporting the web to be dried, and the first support belt being passed through the first dryer group along a meander path so that a first die of the supported paper web comes into direct contact with the first drying cylinders and the first support belt comes into direct contact with the first deflection suction rolls;

a second dryer group immediately following the first dryer group, the second dryer group comprising a second plurality of rotatable, heatable second drying cylinders, which are rotatable in a second direction opposite the first direction; a respective second deflection suction roll between each two of the second drying cylinders; a second endless loop support belt having a respective one side for supporting the web to be dried, and the second support belt being passed through the second dryer group along a second meander path so that the second side of the paper web opposite the first side thereof comes into direct contact with the second drying cylinders and the second support belt comes into direct contact with the second deflection suction rolls;

the first dryer group having a last one of the first drying cylinders in the web path toward the second dryer group, the second dryer group having an initial drying cylinder in the path of the web after the first dryer group; and a transfer roll within the loop of the second endless loop belt, the transfer roll being located between the first and the second dryer groups; the transfer roll being placed with respect to the last of the first drying cylinders and with respect to the initial second drying cylinder that the web passing between those two drying cylinders wraps around a circumference of the transfer roll over a wrap angle of between 30° and 50°, and wherein the web travels along a free, unsupported travel path as the web is transferred from the first belt to the second belt, the free travel path of the web terminating at the circumference of the transfer roll.

31. A dry end of a paper manufacturing machine, comprising:

a first dryer group comprising a first plurality of rotatable, heatable first drying cylinders which are rotatable in a first direction; a respective first deflection suction roll between each two of the first drying cylinders; a first endless loop support belt having one side for supporting the web to be dried, and the first support belt being passed through the first dryer group along a meander path so that a first side of the supported paper web comes into direct contact with the first drying cylinders and the first support belt comes into direct contact with the first deflection suction rolls;

a second dryer group immediately following the first dryer group, the second dryer group comprising a second plurality of rotatable, heatable second drying cylinders, which are rotatable in a second direction opposite the first direction; a respective second deflection suction roll between each two of the second drying cylinders; a second endless loop support belt having a respective one side for supporting the web to be dried, and the second support belt being passed through the second dryer group along a second meander path so that the second side of the paper web opposite the first side thereof comes into direct contact with the second drying cylinders and the second support belt comes into direct contact with the second deflection suction rolls;

the first dryer group having a last one of the first drying cylinders in the web path toward the second dryer group, the second dryer group having an initial drying cylinder in the path of the web after the first dryer group; and a transfer roll within the loop of the second endless loop belt, the transfer roll being located between the first and the second dryer groups; the transfer roll being placed with respect to the last of the first drying cylinders and with respect to the initial second drying cylinder that the web passing between those two drying cylinders wraps around a circumference of the transfer roll over a wrap angle between 30° and 50°;

the last of the first drying cylinders and the transfer roll being so placed, without any interfering elements therebetween, that the web follows a substantially straight, free, unsupported path of travel from the last of the first drying cylinders to the transfer roll as the web is transferred from the first belt to the second belt, the free travel path of the web terminating at the circumference of the transfer roll.

* * * * *